US005572930A

United States Patent [19]

Hein

[11] Patent Number: 5,572,930

[45] Date of Patent: Nov. 12, 1996

[54] ELEVATOR SYSTEM

[76] Inventor: Wilfried Hein, Werraweg 117, D-4800 Bielefeld 11, Germany

[21] Appl. No.: 392,627

[22] Filed: Feb. 23, 1995

Related U.S. Application Data

[63] Continuation of Ser. No. 949,480, filed as PCT/EP92/00236, Feb. 4, 1992 published as WP92/14673, Sep. 3, 1992, abandoned.

[30] Foreign Application Priority Data

Feb. 14, 1991 [DE] Germany ..... 41 04 512.2
Jul. 10, 1991 [DE] Germany ..... 41 22 855.3

[51] Int. Cl.[6] ..... B61B 5/00

[52] U.S. Cl. ..... 104/128; 105/30; 187/250

[58] Field of Search ..... 104/89, 91, 127, 104/128, 129, 53, 55, 106, 107, 124, 126, 246; 105/30, 148, 149, 149.2, 156, 170, 165, 169; 187/12, 13, 14, 250, 200, 201

[56] References Cited

U.S. PATENT DOCUMENTS

| | | | |
|---|---|---|---|
| 2,913,997 | 11/1959 | Wolf | 105/30 |
| 3,774,548 | 11/1973 | Borst | 105/30 |
| 3,999,488 | 12/1976 | Monks | 105/30 |
| 4,015,537 | 4/1977 | Graef et al. | 105/30 |
| 4,185,562 | 1/1980 | Hatori et al. | 105/149 |
| 4,335,805 | 6/1982 | Grass | 187/12 |
| 4,627,517 | 12/1986 | Bor | 187/12 |
| 4,756,387 | 7/1988 | Grass | 187/12 |
| 5,269,227 | 12/1993 | Warren et al. | 105/148 |

FOREIGN PATENT DOCUMENTS

| | | | |
|---|---|---|---|
| 0043592 | 1/1982 | European Pat. Off. | 187/12 |
| 088 061 | 9/1983 | European Pat. Off. . | |
| 0394201 | 10/1990 | European Pat. Off. | 187/12 |
| 2658180 | 8/1991 | France | 105/30 |
| 0479861 | 7/1929 | Germany | 105/30 |
| 592 997 | 2/1934 | Germany . | |
| 1580860 | 8/1979 | Germany | 104/89 |
| 3001298 | 7/1981 | Germany | 187/12 |
| 3103162 | 8/1982 | Germany | 104/89 |
| 30 25 727 | 9/1982 | Germany . | |
| 3504854 | 8/1986 | Germany | 187/12 |
| 87 07 593.8 | 9/1987 | Germany . | |
| 38 19 522 | 2/1989 | Germany . | |
| 778091 | 7/1957 | United Kingdom . | |

*Primary Examiner*—Mark T. Le
*Attorney, Agent, or Firm*—White & Case

[57] ABSTRACT

A lift for inclined or vertical operation has a pair of guide rails that run parallel to one other, on which guide rollers run that are mounted on swivel plates so that they can swivel and contact the rails from opposite sides. At least one guide roller on each swivel plate is designed as a drive roller. The periphery of the drive roller is pressed against a respective engagement area of the rail by a spring force in such a way that the drive force of the drive roller is primarily transferred to the rail by friction.

17 Claims, 11 Drawing Sheets

ELEVATOR SYSTEM

This application is a continuation of application Ser. No. 07/949,480, filed as PCT/EP92/00236, Feb. 4, 1992 published as WO92/14673, Sep. 3, 1992 now abandoned.

BACKGROUND OF THE INVENTION

1. Field of the Invention

The invention relates to a lift of the type used for inclined lift applications, such as chair lifts, in which a frame or chassis member, supported by guide rollers, is moveable along a track having a pair of parallel, tubular guide rails. The present lift can be used either in inclined or vertical lift (i.e., elevator) applications.

2. Description of Related Art

In known inclined lifts, a pair of spaced guide rails are used to guide the rollers. The lift is driven, however, with a separate driving mechanism.

In one known apparatus, an endless cable runs inside the hollow guide rails and is connected to the moveable frame through a slot in the upper guide rail. In another apparatus, the frame is moved via toothed racks that extend parallel to the rails and on which a gear runs.

In German patent No. DE-PS 29 46 780, the frame is driven by a worm that engages a worm gear, in which the gear teeth are laid out on a plurality of plates.

All known lift devices of this general type have the disadvantage that both their production and their assembly are expensive.

European patent application No. 0 088 061 discloses a hanging conveyor, in which a chair lift hangs off a single track tube. A drive device, in frictional contact with the track, is used to move the chair lift along the track. This type of design has the critical disadvantage that it has no secure guide for the suspended load. Therefore, in most cases these designs are not permissible as lifts for people, in particular as lifts for the handicapped.

SUMMARY OF THE INVENTION

The invention is a lift which can be produced economically with simple means and still be satisfactorily functional.

A lift for inclined or vertical operation has a pair of guide rails that run parallel to one other, on which guide rollers run that are mounted on swivel plates so that they can swivel and contact the rails from opposite sides. At least one guide roller on each swivel plate is designed as a drive roller. The periphery of the drive roller is pressed against a respective engagement area of the rail by a spring force in such a way that the drive force of the drive roller is primarily transferred to the rail by friction.

The lift according to the invention has the advantage that there is a secure guiding of the frame in any desired direction and directional change. The lift according to the invention can run both on straight and on curved rails. The guide rails can be either horizontal or vertical, either ascending or descending. In addition, the guide rails can also be curved in the top view and form narrow curves, as this is sometimes necessary, for example, for use in stair wells. The design according to the invention permits any desired travel path.

It has proven particularly effective that the driving force is created by means of a guided pressure spring. Equipping it with a guided pressure spring results in the fact that even in the case where the spring breaks, the remaining spring force maintains a sufficient contact force of the drive rollers on the guide profiles.

It has proven particularly effective that the guided pressure spring extend between the two swivel plates that are fastened so that they can swivel around horizontal axles and it engages at a distance from their swivelling axles.

DESCRIPTION OF THE PREFERRED EMBODIMENTS

Figure 1:
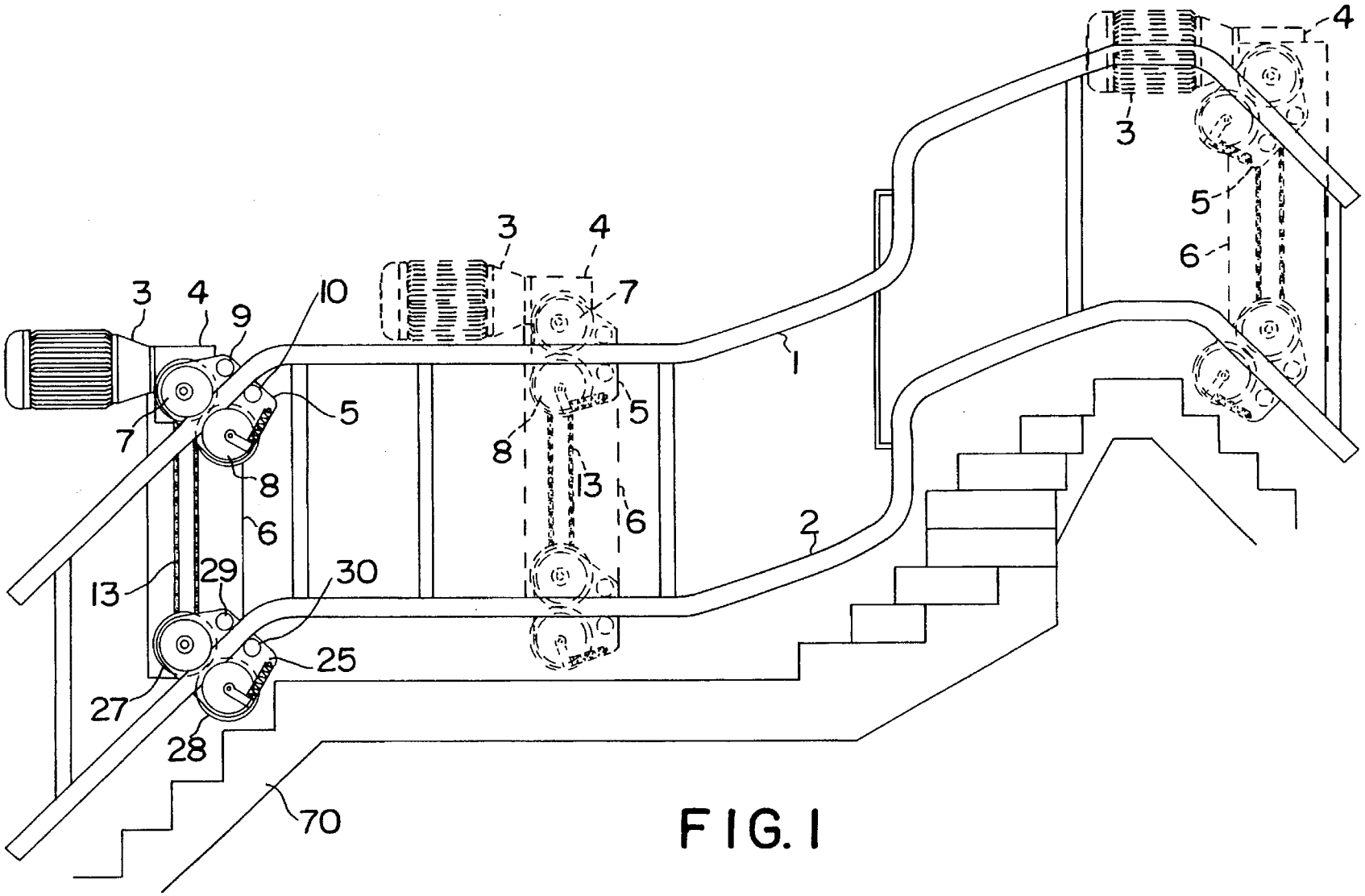
FIG. 1 is a schematic side view of a lift, shown in various positions along the track, according to a first embodiment of the invention.

In the following various embodiments, corresponding parts are designated by one or more primes of the same reference numerals.

Figure 3:
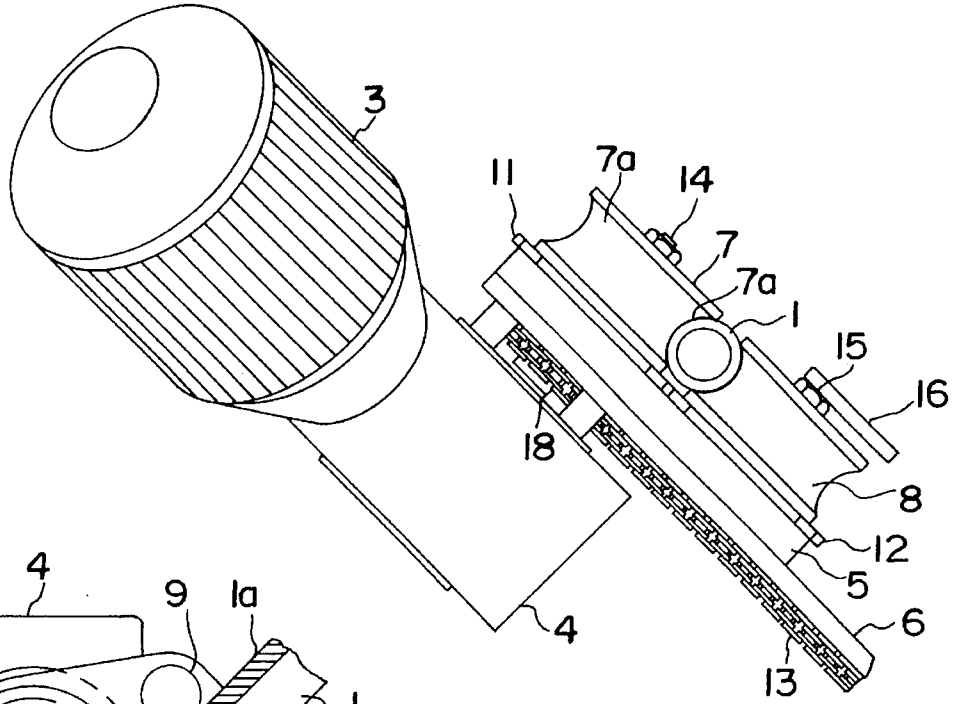
FIG. 3 is an angular view of the upper drive region, looking in the direction of arrow III of FIG. 2.
Figure 2:
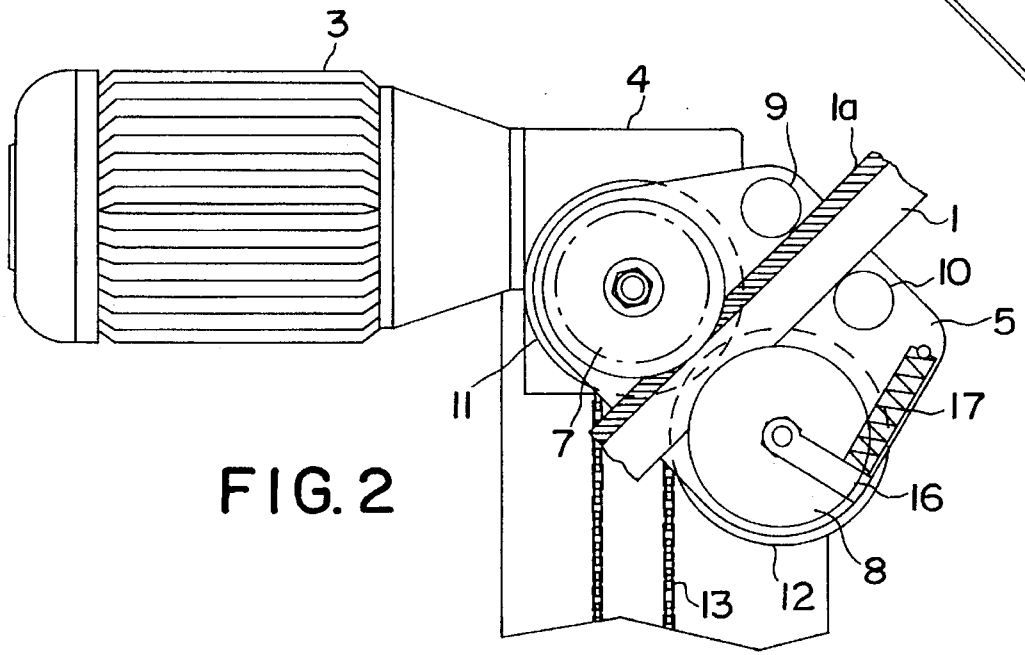
FIG. 2 is an enlarged side view of the upper drive region of the lift of FIG. 1.

Referring to FIGS. 1–3, a pair of tubular guide rails 1 and 2 are arranged along a wall above and to the side of stairs 70. The guide rails 1, 2 are parallel to one other and have a constant gauge, i.e., a constant distance from each other measured vertically.

The lift includes a frame or chassis 6, on which is provided an upper drive assembly that includes a motor 3 and a transmission 4.

The transmission drives a drive roller 7 that is mounted on a swivel plate 5 that can turn about axis 14 relative to the chassis 6, as can be seen from FIG. 1.

The drive roller 7 is coated with a plastic covering 7*a* of polyurethane to increase the friction value. The drive roller 7 is fixed relative to a gear 11 that is mounted on the same axle. The gear 11 engages a gear 12, which in turn is fixed to a second roller 8 that is rotatable about an axis 15. The drive roller 7 and the driven roller 8 clamp the guide rail 1 between the two rollers 7, 8. The guide rail 1 has an engagement area 1*a* that is roughened. The periphery of the drive roller 7, which as shown in FIG. 3 is concave to conform to the tubular shape of the guide rail 1, runs on this engagement area 1*a*. Drive roller 7 and engagement area 1*a* thus are engaged with each other through frictional contact.

A pair of guide rollers 9 and 10 are also rotatably mounted on the swivel plate 5 so as to lie on opposite sides of the guide rail 1.

The distance between rotary axis 14 and rotary axis 15 can be changed because of the fact that the position of the rotary axis 15 is defined by a bolt that is mounted eccentrically (which is not shown) relative to the swivel plate 5. A lever arm 16 is fixed at one end to the eccentric bolt. A spring element 17 engages the other end of this lever arm in such a way that the spring force urges the lever arm 16 to rotate to reduce the spacing between the axes 14 and 15 of the rollers 7, 8. In this way the contact force between the roller pair 7, 8 and the guide rail 1 can be selected corresponding to the spring force.

A chain pinion 18 is mounted on the same axle as the drive roller 7 for rotation therewith. A drive chain 13 runs over the chain pinion 18 and engages a corresponding pinion on a lower drive, which includes a lower drive roller 27. The lower drive is similar in structure to the upper drive except that the drive roller 27 is driven by the lower chain pinion and drive chain 13, rather than by a motor and transmission. As in the case of the upper drive roller 7, the lower drive roller 27 is connected to drive a second roller 28 via gears, similar to gears 11 and 12. Guide rollers 29 and 30 rest on a lower swivel plate 25 that is installed so that it can swivel relative to the chassis 6.

Figure 4:
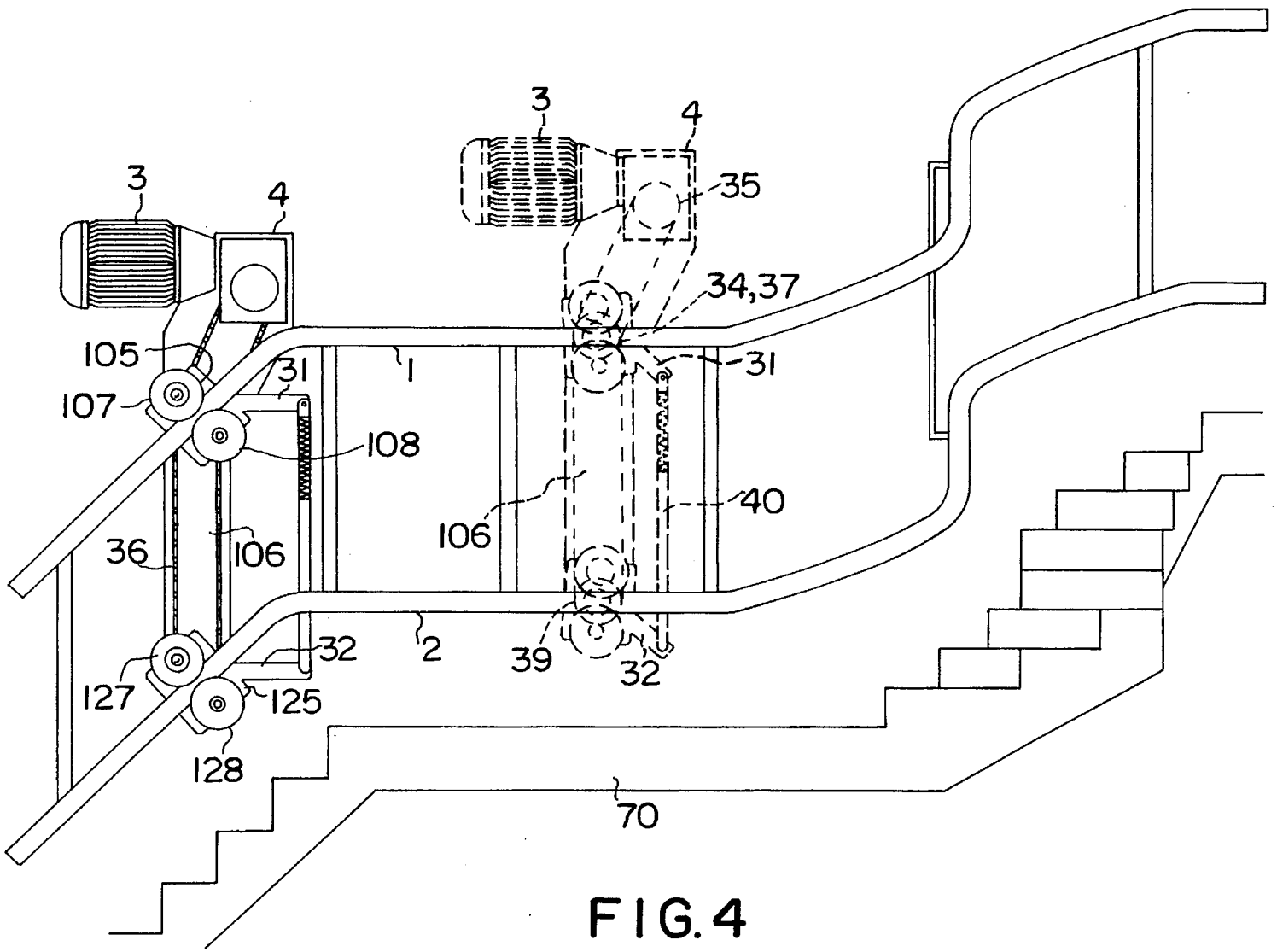
FIG. 4 is a schematic side view of a second embodiment.
Figure 5B:
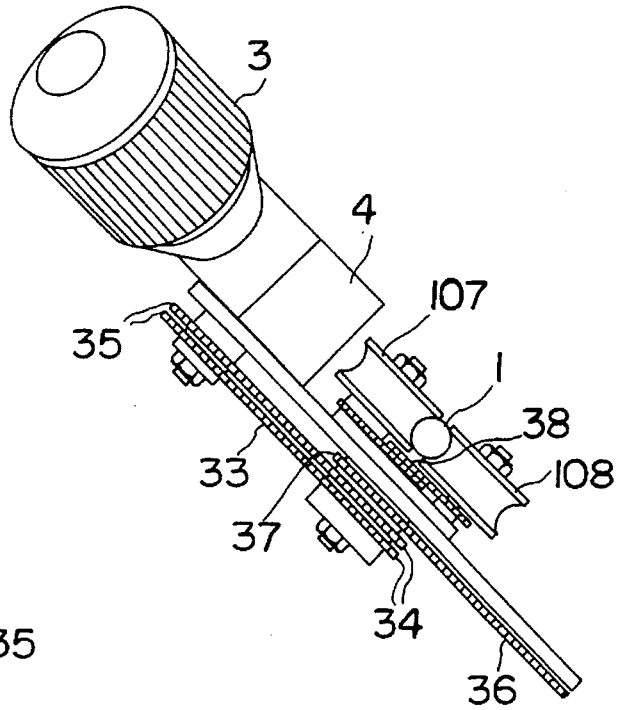
FIG. 5*b* is an angular view of the upper drive region, looking in the direction of arrow Vb of FIG. 5*a;*
Figure 5A:
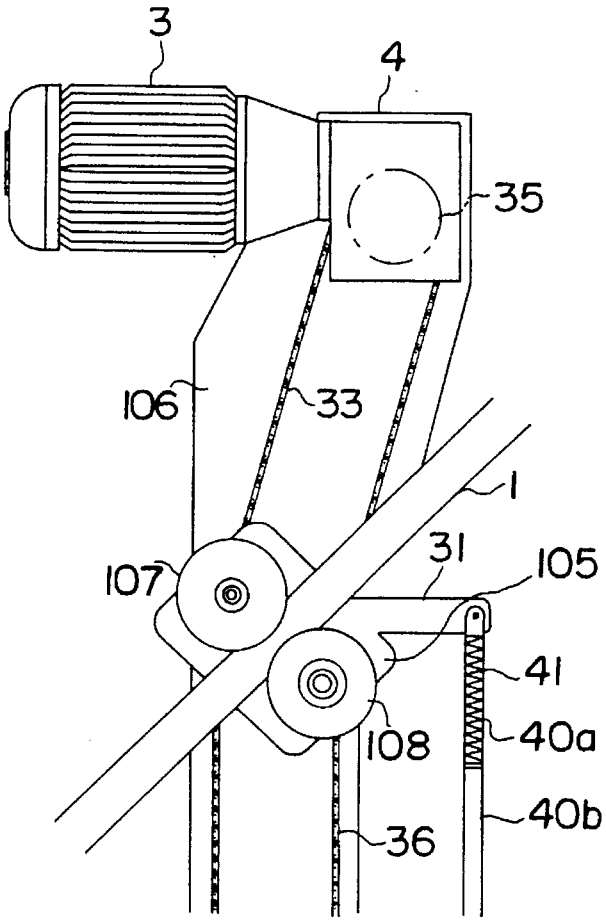
FIG. 5*a* is an enlarged side view of the upper drive region of the lift of FIG. 4.

FIGS. 4, 5*a*, and 5*b* illustrate a second embodiment, in which the upper drive roller 107 is coupled to the motor 3 and transmission 4 by way of double chain gears 34 and 35 and double chain 33. The rotary axis of the double chain gear 34 is also the swivel axis for the swivel plate 105 on chassis 106. Chain gear 34 rotates two other gears, a central gear 38 and a chain gear 37. Gear 38 in turn engages a gear on drive roller 107, and a gear on roller 108, causing the two rollers 107 and 108 to rotate in opposite directions.

A chain 36 engages the chain gear 37, and also a chain gear 39 on the lower drive assembly (see FIG. 4), which transfers its rotary motion to the lower drive rollers 127 and 128, mounted on the a swivel plate 125, in a manner similar to the upper drive assembly.

The upper swivel plate 105 has a lever arm 31. The lower swivel plate also has a lever arm. 32. A lever 40 with a variable length is attached to the free ends of the lever arms 31 and 32. The lever 40 includes a tube 40*a* that closely surrounds pin 40*b*, but still allows movement. A pressure spring 41 urges the lever 40 to elongate, and in this process rotates the two swivel plates 105 and 125 in opposite directions to each other by engagement on the lever arms 32 and 31. In this process, drive roller 107 and corresponding roller 108, as well as drive roller 127 and roller 128, are pressed against the respective guide rails 1 and 2.

Figure 6:
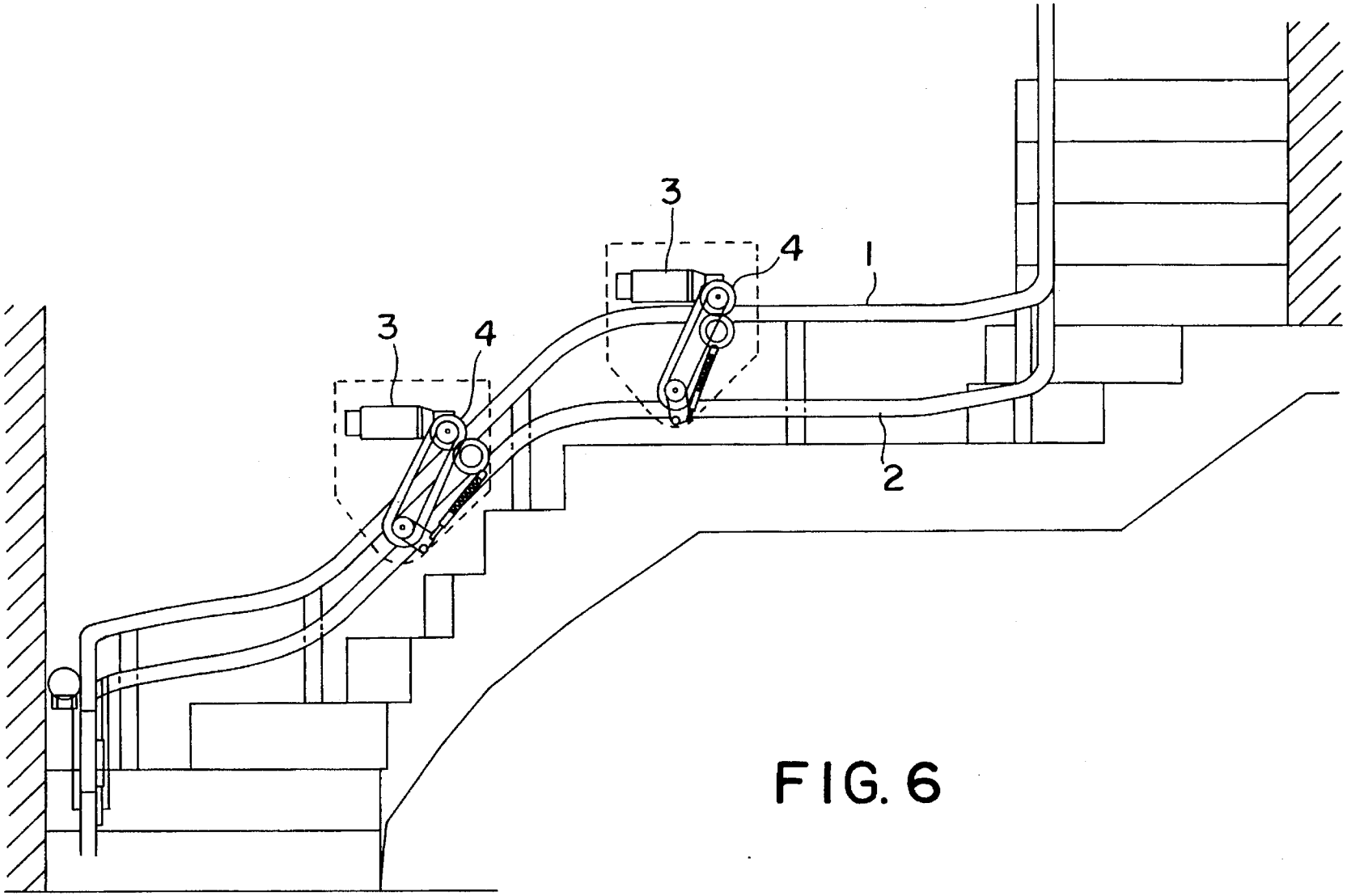
FIG. 6 is a schematic side view of a third embodiment, that is designed as a chair lift.
Figure 8:
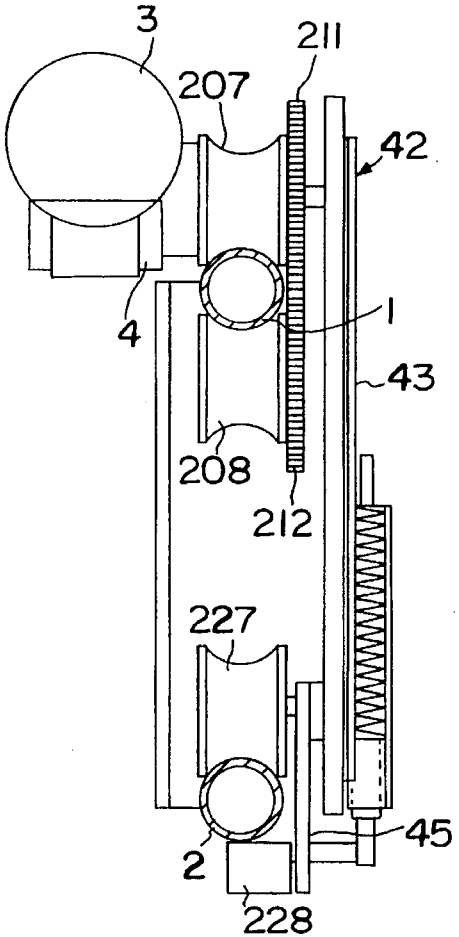
FIG. 8 is a schematic front view of the chair drive mechanism of FIG. 6, looking in the direction of arrow VIII of FIG. 7.
Figure 7:
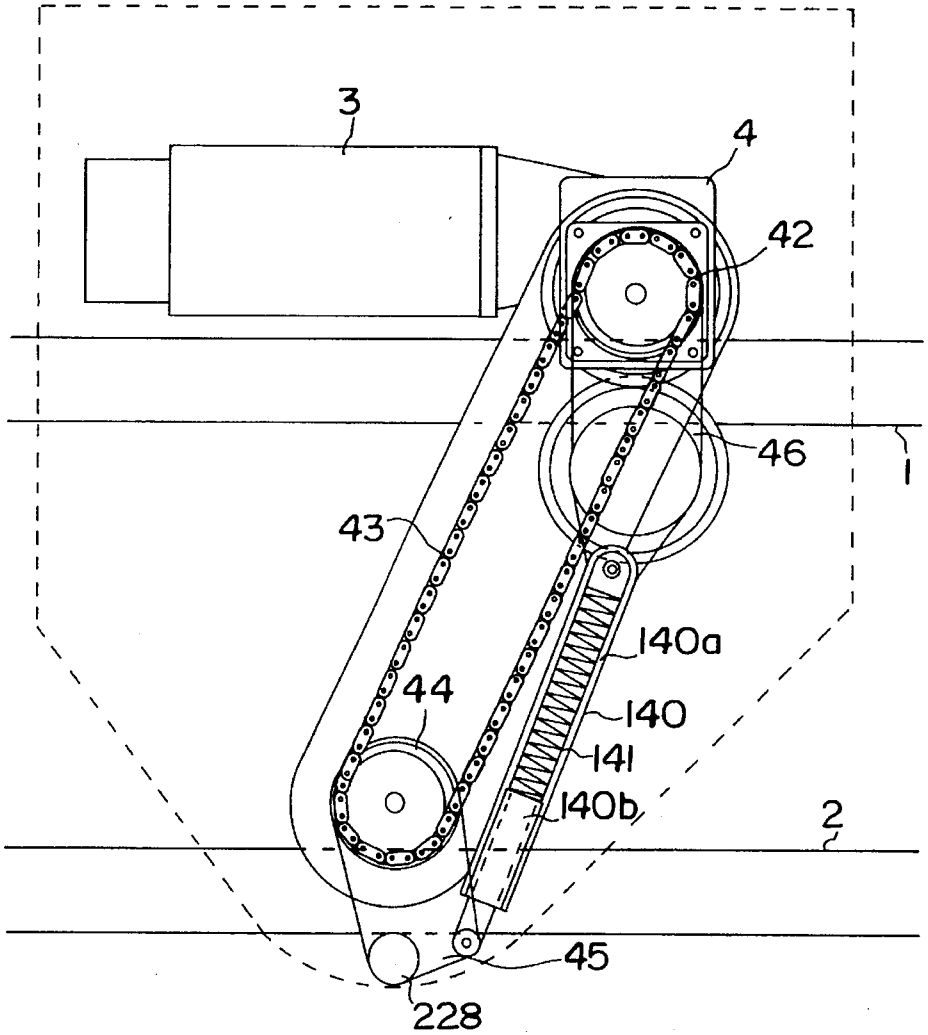
FIG. 7 is an enlarged side view of the chair drive mechanism of FIG. 6.

FIGS. 6 to 8 illustrate an example of a chair lift. A motor 3 and transmission 4 drive a drive roller 207 which is fixed to a gear 211 for rotation therewith. The gear 211 meshes with a gear 212, that is fixed to another roller 208.

Rotation of the drive roller 207 rotates a chain gear 42, which is connected to a lower chain gear 44 by a chain 43. This lower chain gear 44 is connected to the lower drive roller 227 so that it turns with it. The lower drive roller 227 is rotatably mounted on a swivel plate 45, whose swivel axis is coincident with that of the drive roller 227. The lower swivel plate 45 has a relatively small roller 228 disposed on the opposite side of guide rail 2 from drive roller 227.

The upper drive roller 207 and the associated driven roller 208 are mounted on an upper swivel plate 46. A lever 140 that can vary slightly in length extends between the upper swivel plate 46 and the lower swivel plate 45. The lever 140 includes a tube 40*a* and a piston 140*b*. A pressure spring 141 attempts to expand the lever 140 and thereby increase the distance between the linking points, and in so doing presses the drive rollers against the tubular guide rails 1 and 2.

Figure 9:
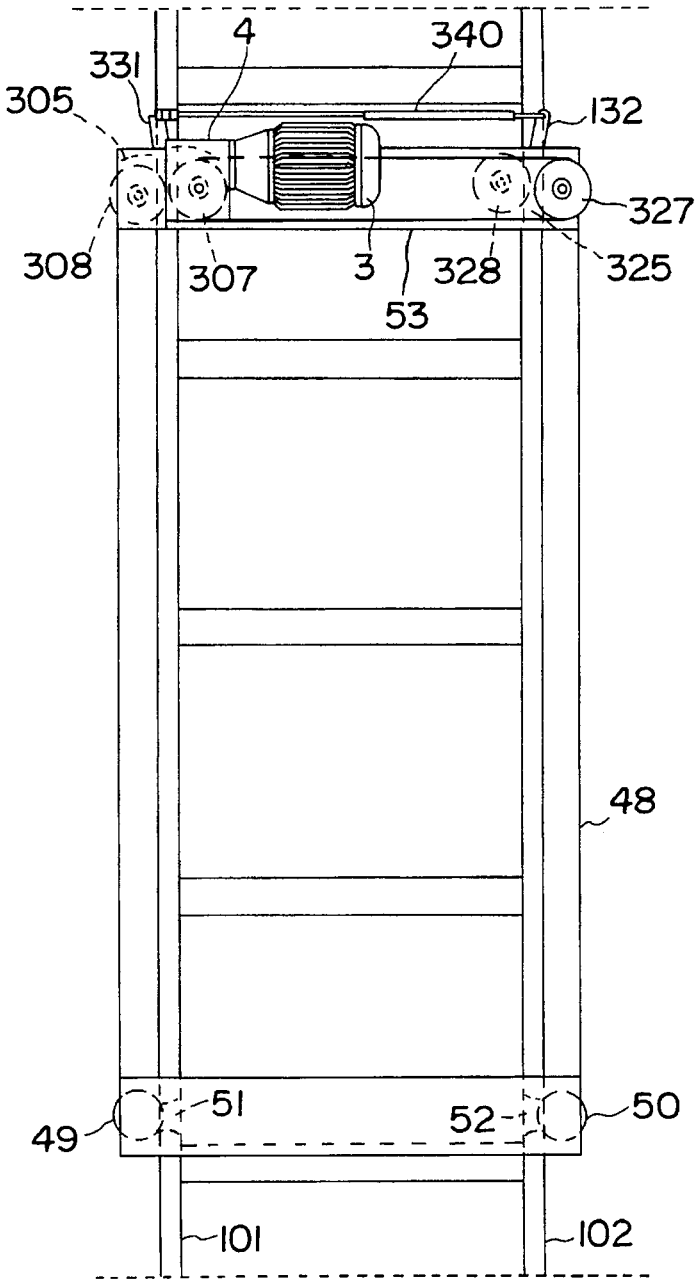
FIG. 9 is a side view of a vertical lift that is only partially shown.
Figure 10:
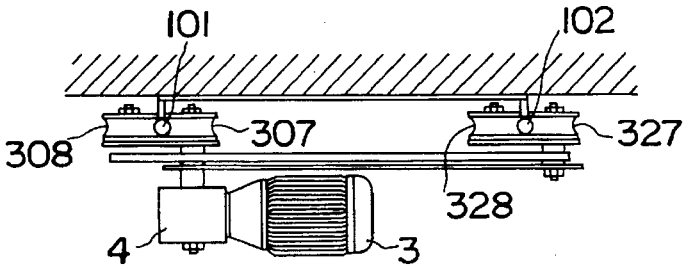
FIG. 10 is a top view of the drive unit of the vertical lift, looking in the direction of arrow X in FIG. 9.

FIGS. 9 and 10 show a vertical lift, i.e., an elevator, with a pair of rails 101 and 102 that are secured to a vertical wall. Only the frame 48 of the elevator car is shown. The lower end of the frame has two running rollers 49 and 50 that rotate in a plane parallel to the vertical wall, and two additional guide rollers 51 and 52 that are oriented at 90° to the rollers 49 and 50.

The drive assembly, which is mounted at the upper end of the frame 48, includes a motor 3 with transmission 4. The transmission 4 turns a drive roller 307 which is linked to another drive roller 327 by a chain 53. The drive roller 307 is mounted on a swivel plate with another roller 308. The swivel plate can swivel relative to the rail 1, and includes a lever arm. 331. The drive roller 327 is mounted with its corresponding roller 328 on a swivel plate 325 having a lever arm 332. A lever 340 with variable length is mounted between the two free ends of the lever arms 331 and 332, and is designed in the same manner as the lever arm 40 in the embodiment according to FIGS. 4 and 5*a*.

Figure 11:
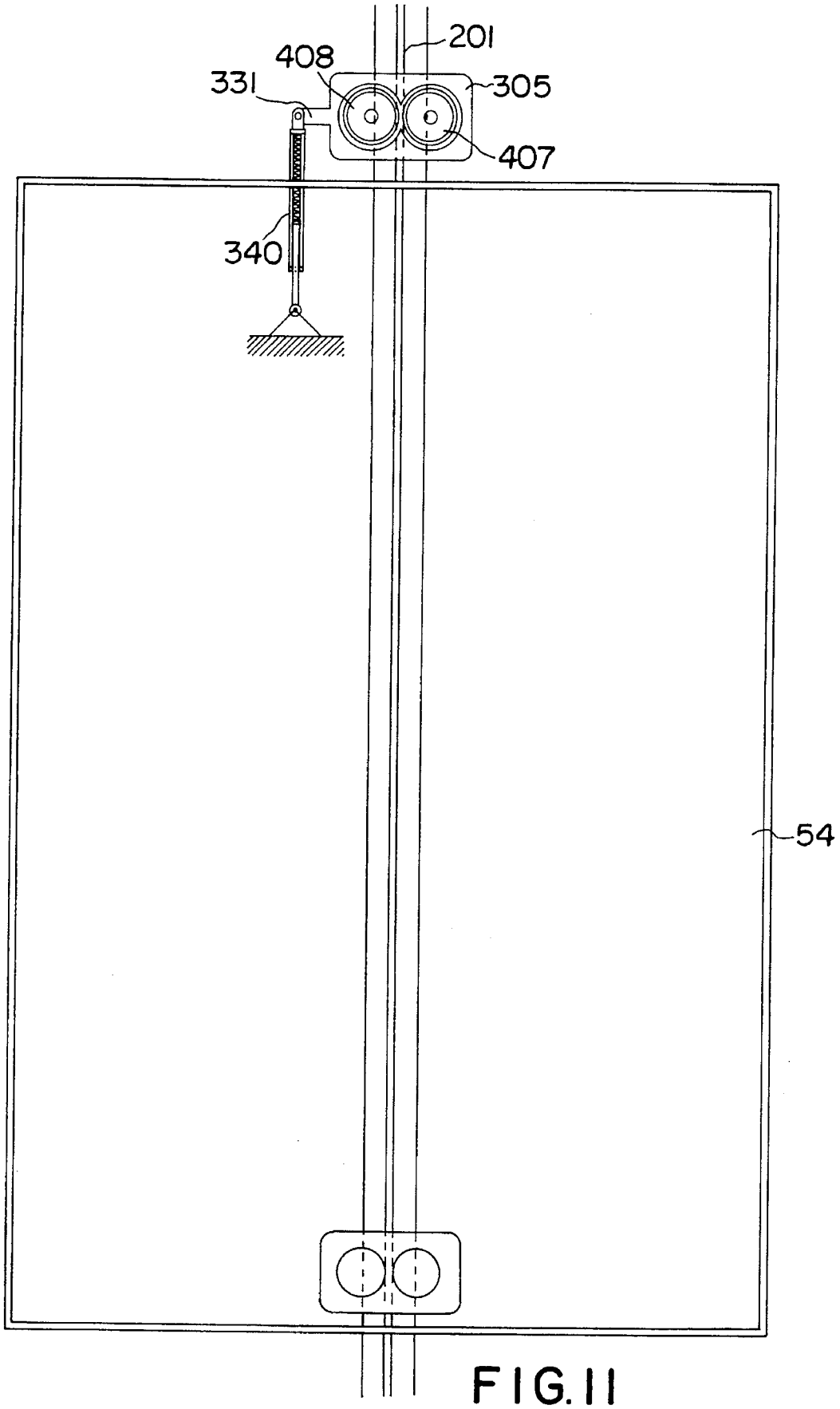
FIG. 11 is a schematic side view of another embodiment of a vertical lift.
Figure 12:
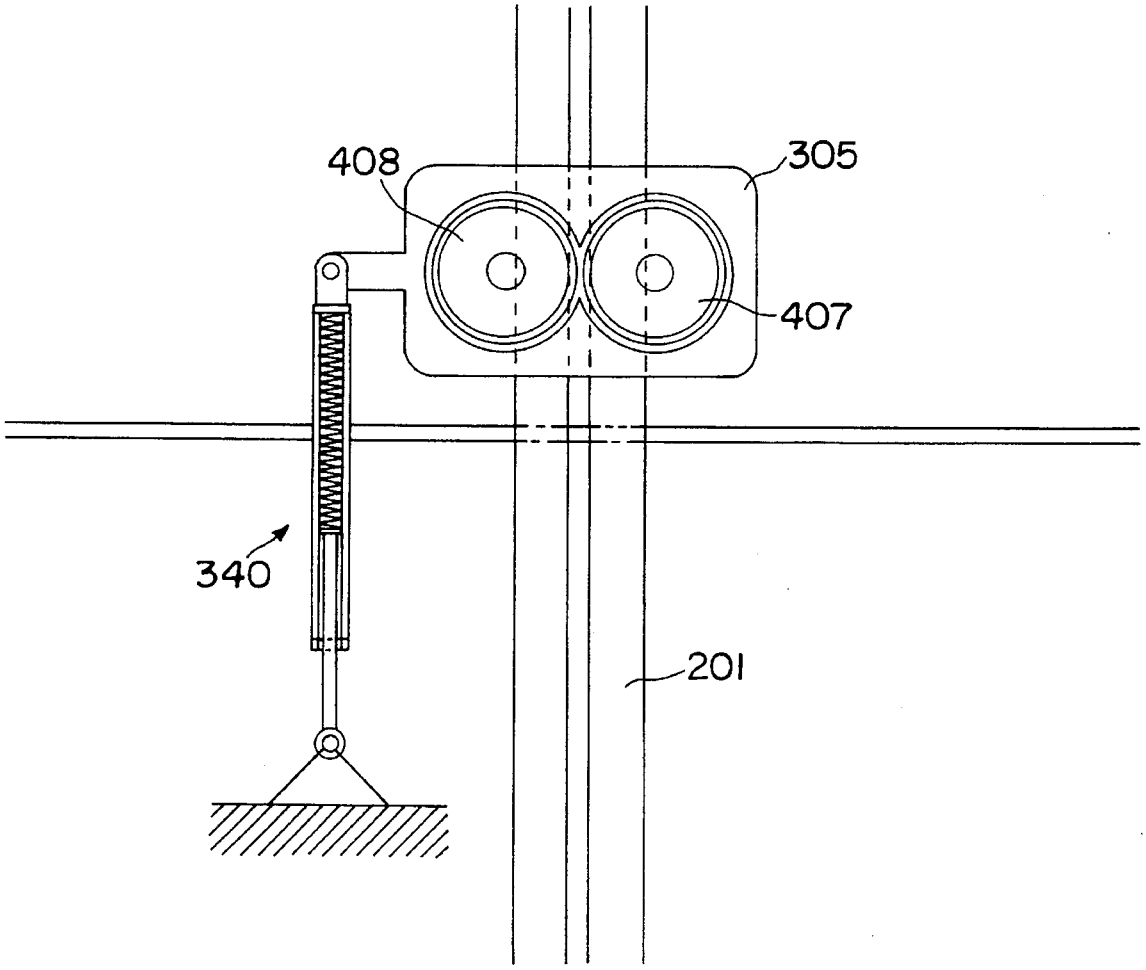
FIG. 12 is an enlarged side view of the drive mechanism of FIG. 11.
Figure 13:
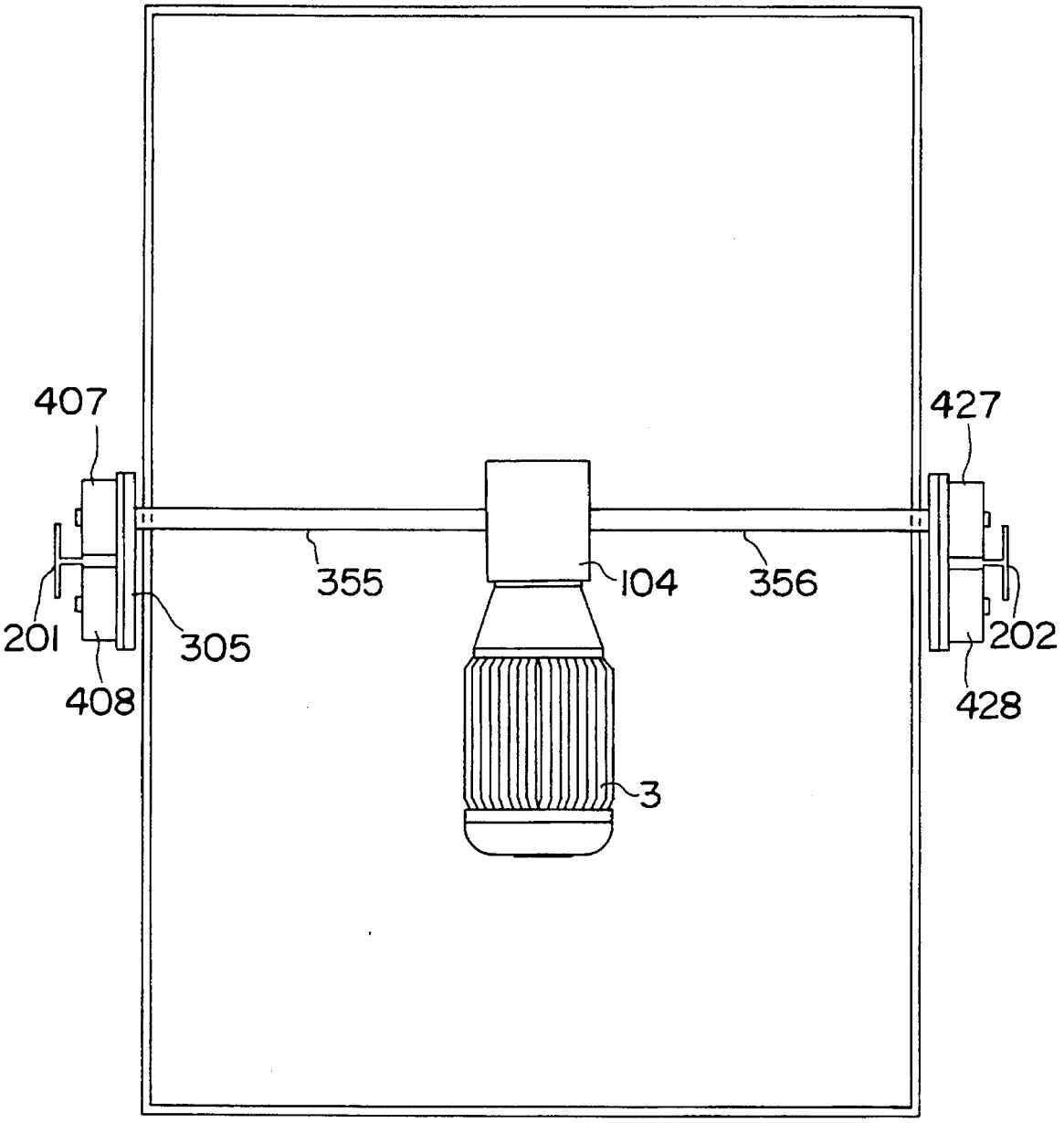
FIG. 13 is a top view of the vertical lift shown in FIGS. 11 and 12.

FIGS. 11 to 13 show a vertical lift with two guide rails 201 and 202 that are mounted on opposite sides of the elevator shaft, adjacent the elevator car. The guide rails are designed as T-profiles in this embodiment. Drive rollers 407 and 408 run on opposite sides of one of the T-profiles, and drive rollers 427 and 428 run on opposite sides of the other T-shaped guide rail 202. The rollers are mounted on the corresponding swivel plates. When swivelled, the drive roller 407 and the roller 408 are pressed from opposite sides against the center shank of the T profile 201. Swiveling occurs by means of a lever 340 with variable length that engages lever arm 331 and supports itself with its other end linked to the frame of the elevator car.

The elevator car 54 is driven by means of a motor 3 and a transmission 104, which has two output shafts 355 and 356 extending in opposite directions. The drive roller 407 is mounted at the end of the output shaft 355, and the drive roller 427 is coupled to the end of the output shaft 356. The drive roller pairs 407, 408 and 427, 428, respectively, are also linked to each other by meshing gears as shown.

Figure 14:
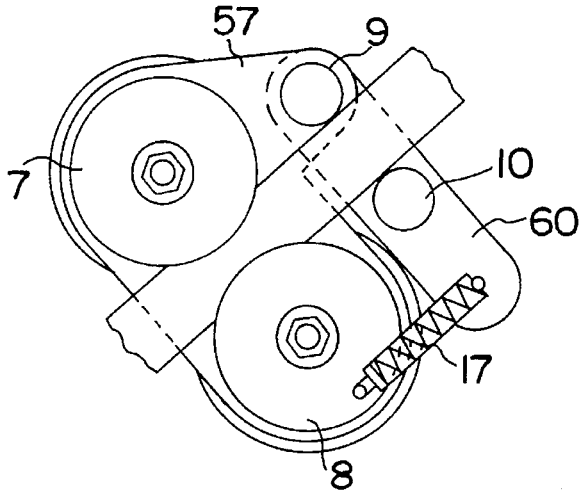
FIGS. 14–16 are side views of three additional embodiments of drive assemblies.
Figure 15:
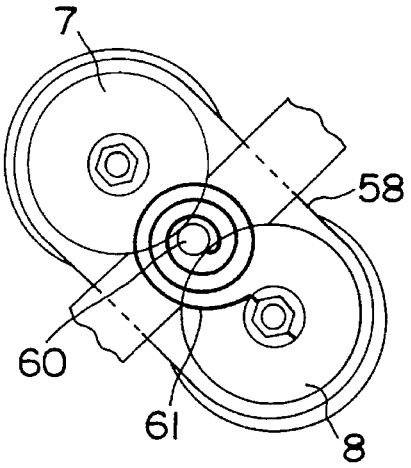
Figure 16:
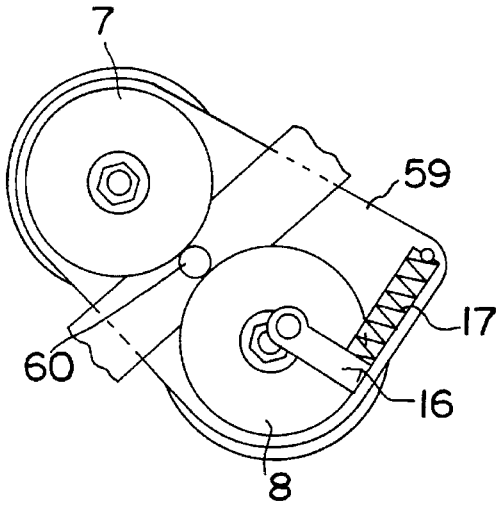

FIGS. 14 to 16 show three additional embodiments of swivel plates with drive rollers that are held under tension in a different manner via springs.

In FIG. 14, the drive roller 7, the gear 8, and a guide roller 9 are mounted on a swivel plate. A flange 60 is mounted on the same axle as the guide roller, so that it can swivel. A guide roller 10 is mounted on flange 60 opposite the guide roller 9. A pressure spring 17 engages flange 60, and is linked at its other end to the swivel plate 57.

In the embodiment according to FIG. 15, the swivel plate 58 is mounted so that it can swivel about a swivel axle 60. The swivel axle runs through the center of the guide rail. A spiral spring is fastened at its center to the swivel axle 60, with its outer end is secured, either directly or indirectly, to the swivel plate 58 at a distance from the swivel axle.

In the embodiment according to FIG. 16, a swivel plate 59 is provided that can also be swivelled around swivel axle 60, the center of which extends through the center of the guide rail. The roller 8 of the roller pair 7, 8 is mounted on an eccentric bolt, which a lever 16 engages. A pressure spring 17 is mounted between the free end of the lever 16 and the swivel plate 59.

The drive mechanisms according to FIGS. 14 to 16 can be used in place of the drive assemblies described in connection with FIGS. 1 to 13.

The pressure of the running rollers, when they are designed of metal, thus with a metal on metal material contact, leads to the fact that the tubular guide rails in the area of the drive roller will be pressed inwardly under the influence of the contact pressure. In practical versions, indented areas or "dents" are formed locally where the rollers contact the rails, in which areas the bearing tube exhibits a diameter that is about 1 mm smaller than the diameter of the unstressed tube. As the lift travels along the rails, the dent travels with it. The driving path tube is thus fulled during the driving process. The migrating dent is compensated again by the inherent elasticity of the driving tube after removal of the contact stress by the drive rollers so that, when not under load, the driving tube maintains the original cylindrical form with the original diameter.

We claim:

1. An elevator system comprising:

a first rail extending in a vertical direction and secured to a vertical wall;

an elevator car, including a frame, that is moveable up and down along said rail;

a first pair of rollers disposed on opposite sides of said first rail;

coupling means for coupling said first pair of rollers to said frame;

pressing means for pressing the rollers of said first pair against said first rail from opposite directions to create friction between said first rail and the rollers of said first pair, wherein the rollers of said first pair contact said first rail only by friction;

drive means coupled to at least one roller of said first pair for selectively rotating the said at least one roller so as to act as a first drive roller, wherein said pressing means creates sufficient friction between said drive roller and the first rail that, in response to actuation of said drive means, said elevator car moves up or down, as the other roller of said first pair rotates, due to rotation of said first drive roller;

a second, vertically extending rail which is secured to a vertical wall and which is spaced from said first rail, a second pair of rollers disposed on opposite sides of said second rail, coupling means for coupling said second pair of rollers to said frame, and pressing means for pressing the rollers of said second pair against said second rail from opposite directions to create friction between said second rail and the rollers of said second pair, wherein the rollers of said second pair contact the respective rail only by friction;

wherein said coupling means includes a pair of swivel plates, pivotally coupled to said frame about swivel axes, for supporting the weight of said elevator car, and a pair of said rollers are rotatably mounted on each said swivel plate; and wherein said pressing means creates sufficient frictional force between said rollers and the respective rails to support the weight of said elevator car, and said pressing means includes a spring means that engages said swivel plates at locations spaced from the respective swivel axes to urge said swivel plates to rotate about their respective axes.

2. An elevator system according to claim 1, comprising drive coupling means for coupling said drive means to a roller of said second roller pair, such that the said roller of said second roller pair acts as a second drive roller.

3. An elevator system according to claim 2, wherein said drive coupling means constitutes a means for coupling said second drive roller to said first drive roller for rotation therewith.

4. An elevator system according to claim 2, wherein said drive means includes a first output coupled to said first drive roller, and a second output coupled to said second drive roller, said second output constituting said drive coupling means.

5. An elevator system according to claim 2, comprising means for coupling said first drive roller to the other roller of the said respective roller pair for rotation in the direction opposite to said drive roller, such that both rollers of the said roller pair act as drive rollers.

6. An elevator system according to claim 5, comprising means for coupling the second drive roller to the other roller of its said respective roller pair for rotation in the direction opposite to said drive roller, such that all four rollers act as drive rollers.

7. An elevator system according to claim 1, wherein the swivel axis of each said swivel plate is horizontal and is coincident with the midpoint of the respective said rail.

8. An elevator system according to claim 1, wherein the said swivel axis of each said swivel plate is horizontal and coincident with the rotation axis of one of the said rollers of the said roller pair.

9. An elevator system according to claim 1, wherein said pressing means comprises an eccentric mounting means for mounting one of the rollers of the roller pair such that the said one roller is selectively moveable toward and away from the other roller of the roller pair.

10. An elevator system according to claim 9, wherein said pressing means further comprises a lever arm coupled to said eccentric mounting means, and said spring means acting on said lever arm for urging the said one roller toward the other roller.

11. An elevator system according to claim 1, further comprising a flange portion which is pivotable relative to said swivel plate, a pair of guiding rollers spaced from the said roller pair and located on opposite sides of the respective rail, wherein one roller is located on the swivel plate and has an axis coincident with the flange pivot axis, and wherein the other roller is located on the flange, and said spring means between the flange and the swivel plate for urging the rollers against the rail.

12. An elevator system according to claim 1, wherein said rollers are coated with a plastic material for increased friction.

13. An elevator system according to claim 12, wherein said first rail has a roughened surface contacting said first drive roller, for increased friction.

14. An elevator system according to claim 1, wherein said first rail has a roughened surface contacting said first drive roller, for increased friction.

15. An elevator system according to claim 1, wherein said first and second rails are located on opposite sides of said frame, and wherein said drive means is coupled to one of the rollers of each said roller pair, such that there is at least one drive roller associated with each rail.

16. An elevator system according to claim 1, wherein said rails are hollow, tubular rails, and wherein said pressing means applies sufficient force as to cause said rollers to compress the rails slightly at the points of contact.

17. An elevator system according to claim 1, wherein said rollers are coupled to the frame at a first vertical location, and comprising at least two guide rollers, one engaging each said rail and being coupled to said frame at a second vertical location.

* * * * *